US008792670B2

(12) United States Patent
Schoerkmaier

(10) Patent No.: US 8,792,670 B2
(45) Date of Patent: Jul. 29, 2014

(54) LOUDSPEAKER AND SYSTEM FOR ACTIVE NOISE CANCELLATION

(75) Inventor: Martin Schoerkmaier, Graz (AT)

(73) Assignee: AMS AG, Unterpremstätten (AT)

( * ) Notice: Subject to any disclaimer, the term of this patent is extended or adjusted under 35 U.S.C. 154(b) by 721 days.

(21) Appl. No.: 13/004,653

(22) Filed: Jan. 11, 2011

(65) Prior Publication Data

US 2011/0170699 A1 Jul. 14, 2011

(30) Foreign Application Priority Data

Jan. 11, 2010 (DE) ..... 10 2010 004 312

(51) Int. Cl.
*H04R 1/00* (2006.01)

(52) U.S. Cl.
USPC ..... 381/398; 381/423; 381/424

(58) Field of Classification Search
USPC ..... 381/398, 423, 424
See application file for complete search history.

(56) References Cited

U.S. PATENT DOCUMENTS

| | | | | |
|---|---|---|---|---|
| 5,182,774 | A * | 1/1993 | Bourk | 381/71.6 |
| 7,031,488 | B2 * | 4/2006 | Chang | 381/398 |
| 2009/0136055 | A1 | 5/2009 | Grell et al. | |

FOREIGN PATENT DOCUMENTS

| | | |
|---|---|---|
| DE | 10 2005 052 548 | 5/2007 |
| DE | 10 2008 049 932 | 5/2009 |
| EP | 1 850 632 | 4/2007 |
| GB | 2 453 434 | 4/2009 |

* cited by examiner

*Primary Examiner* — Davetta W Goins
*Assistant Examiner* — Amir Etesam
(74) *Attorney, Agent, or Firm* — McDermott Will & Emery LLP

(57) ABSTRACT

A loudspeaker for active noise cancellation is disclosed in which a measurement microphone (12) is arranged at the acoustic center. In addition, a system for active noise cancellation is described.

11 Claims, 3 Drawing Sheets

LOUDSPEAKER AND SYSTEM FOR ACTIVE NOISE CANCELLATION

RELATED APPLICATION

This application claims the priority of German patent application no. 10 2010 004 312.5 filed Jan. 11, 2010, the entire content of which is hereby incorporated by reference.

FIELD OF THE INVENTION

The invention relates to a loudspeaker and to a system for active noise cancellation.

BACKGROUND OF THE INVENTION

The active noise cancellation, also called active noise compensation, is used, for example, in headphones, earphones, or telephones, in order to damp undesired and disruptive background noise and to reproduce the wanted sound so that it is more easily understandable. Therefore, for a user, a clear quality improvement of the reproduced speech and/or music is achieved. In order to achieve active noise cancellation, there are two different approaches, namely feedback and feed forward. The approach forming the basis of this application is based on feedback.

In a known system with active noise compensation by feedback, a microphone is positioned in front of a loudspeaker. The microphone measures the ambient noise. The microphone signal is converted in a feedback loop (i.e., a control loop with feedback) and fed together with a wanted signal to the loudspeaker. The signal feedback and preparation causes suppression of the ambient noise.

In the case of feedback, with respect to the frequency, phase shifts occur, wherein a so-called phase margin that is required for a stable operation of the feedback loop becomes limited. These frequency-dependent phase shifts are caused, for example, by the loudspeaker, the microphone, the acoustic properties of the housing surrounding the microphone and loudspeaker, and the distances between the individual components.

Measurements have shown that, in particular, the distance between the loudspeaker and microphone causes a time delay that results in a linear phase shift as a function of frequency. This time delay, which significantly reduces the phase margin at high frequencies, cannot be compensated in feedback. In the case of a phase shift of greater than 180°, the negative feedback transforms into feed forward and the feedback loop begins to oscillate. From the measurements, it is clear that a larger distance between the loudspeaker and microphone causes a larger phase shift.

SUMMARY OF THE INVENTION

One object of the invention is to improve the stability of the control loop.

In one embodiment, for a loudspeaker for active noise cancellation, a measurement microphone is arranged at the acoustic center of the loudspeaker.

The measurement microphone captures the sound to be suppressed or the background noise to be suppressed.

Through the especially advantageous arrangement of the measurement microphone at the acoustic center of the loudspeaker, the distance and thus the sound transmission path between the loudspeaker and measurement microphone is reduced to a minimum. A phase shift resulting from this distance in a loudspeaker-microphone transmission function is likewise minimized. Consequently, the stability of a lockable control loop is significantly improved.

The loudspeaker is designed, for example, as an electrodynamic loudspeaker.

In one refinement, the loudspeaker has a magnet, an oscillation coil, and a loudspeaker membrane. The magnet is designed for generating a constant magnetic field. The oscillation coil is arranged in the area of the constant magnetic field and is designed as an electrodynamic driver of the loudspeaker in interaction with the magnet. The loudspeaker membrane is suspended, connected mechanically to the magnet, between an inner and an outer border. The measurement microphone is here arranged in the middle of a space surrounded by the inner border of the loudspeaker membrane.

The magnet is constructed as a permanent magnet. The space surrounded by the inner border of the loudspeaker membrane is, for example, a plane.

The acoustic center of the loudspeaker is located in the middle of the oscillation coil. The loudspeaker membrane is not continuous, but instead has a recess in its center. The measurement microphone is arranged in this recess of the loudspeaker membrane. The arrangement of the measurement microphone is consequently central. It could also be designated as concentric or coaxial.

The center of the loudspeaker does not move, wherein it is advantageously possible to position the measurement microphone directly in the acoustic center of the loudspeaker. A time delay, which would be caused by the distance between the measurement microphone and the loudspeaker, is as small as possible.

In another embodiment, the outer border of the loudspeaker membrane is connected to the oscillation coil. The inner border of the loudspeaker membrane is connected to the magnet.

The loudspeaker membrane is set into oscillation by the movements of the oscillation coil in the area of the constant magnetic field. The recess in the theoretical center of the loudspeaker membrane leaves space in order to hold the measurement microphone.

In one refinement, the loudspeaker has a loudspeaker housing. This is connected to the outer border of the loudspeaker membrane and to a bottom side of the magnet. The loudspeaker housing has an equalization opening.

The loudspeaker housing encloses the loudspeaker. The equalization opening or leak is used for compensation of the air movement generated during the operation of the loudspeaker in the interior of the loudspeaker housing.

In another embodiment, at least two contacts are provided on the bottom side of the loudspeaker housing for feeding a loudspeaker signal and for providing a noise signal in the function of the measurement microphone.

The contacts are constructed, for example, as spring contacts. The noise signal comprises a signal captured by the measurement microphone. The noise signal is a function of the ambient noise to be suppressed. The loudspeaker signal comprises a compensation signal generated as a function of the noise signal and a wanted signal. The wanted signal comprises the desired acoustic information.

The contacts are advantageously attached to the bottom side of the loudspeaker housing.

In one refinement, the loudspeaker membrane is constructed as a flat membrane in a round or square shape.

The loudspeaker membrane is also designated as a ring emitter.

In another embodiment, the measurement microphone is constructed as an electret microphone or as a so-called MEMS, micro-electro-mechanical, microphone, that is, as a microphone using micro-system technology.

In one refinement, the loudspeaker is constructed as a surface-mounted component.

The loudspeaker is realized, in this case, as a so-called Surface Mounted Device, SMD, and thus could be mounted on a so-called Printed Circuit Board, PCB.

In one refinement, the loudspeaker is suitable for use in a control system with signal feedback.

The control system with signal feedback is a so-called feedback system.

In one embodiment, a system for active noise cancellation has a loudspeaker and a control loop coupled with the loudspeaker. A noise signal provided by the measurement microphone of the loudspeaker is fed to one input of the control loop. A compensation signal is provided on the output of the control loop. The compensation signal is fed, superimposed with a wanted signal, to the loudspeaker as the loudspeaker signal.

The measurement microphone measures the ambient noise present on the loudspeaker and provides the noise signal as a function of this ambient noise. The noise signal is prepared in the control loop and converted into the compensation signal. The compensation signal is fed to the loudspeaker together with the wanted signal.

Through the arrangement of the measurement microphone in the acoustic center of the loudspeaker, only a very small time delay occurs and thus only a small phase shift of the noise signal. This leads to an increase in the phase margin in the control loop and thus increases the bandwidth of the entire system for active noise cancellation. The stability of the control loop is significantly increased.

The system for active noise cancellation is thus a so-called feedback system.

In one refinement, the control loop comprises a filter that is coupled with the input of the control loop and an inverter that is connected after this filter and on whose output the compensation signal is provided.

The filter preferably realizes the inverse transmission function of the loudspeaker microphone system response, the so-called open loop response. The filter is designed so that the phase margin and a so-called gain margin of the control loop are maintained. The inverter inverts the signal provided by the filter. By superimposing the compensation signal with the wanted signal, noise in the wanted signal is suppressed or canceled out.

BRIEF DESCRIPTION OF THE DRAWINGS

The invention will be explained in detail below using several embodiments with reference to the figures. Components that are identical in function or effect carry identical reference signs. In so far as components correspond in their function, their description will not be repeated in each of the figures.

DETAILED DESCRIPTION OF THE DRAWINGS

Figure 1:
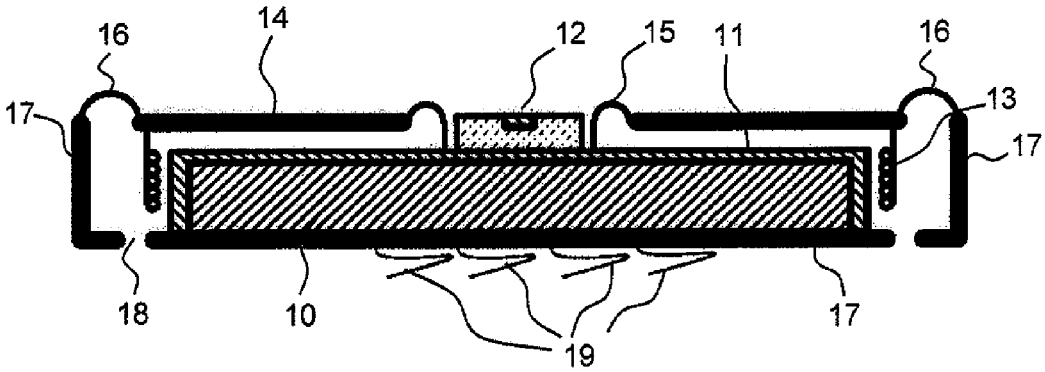
FIG. 1 depicts a first example embodiment of a loudspeaker according to the invention, shown as a section taken along line in FIG. 2.

FIG. 1 shows a first example embodiment of a loudspeaker for active noise cancellation according to the invention. The loudspeaker is shown in a sectioned side view. The loudspeaker comprises a magnet 10 with a housing 11, a measurement microphone 12, an oscillation coil 13, a loudspeaker membrane 14, and a loudspeaker housing 17. The microphone opening is also shown for the measurement microphone 12. The measurement microphone 12 is arranged on the magnet 10. The loudspeaker membrane 14 is suspended between an inner border 15 and an outer border 16. The loudspeaker membrane 14 has a recess. In this recess, which is surrounded by the inner border 15 of the loudspeaker membrane 14, the measurement microphone 12 is supported on the magnet 10. The oscillation coil 13 is arranged adjacent to the magnet 10 and is connected to the outer border 16 of the loudspeaker membrane 14. The loudspeaker housing 17 is likewise connected to the outer border 16. In addition, a housing 11 is provided that surrounds the magnet 10 together with the loudspeaker housing 17. The loudspeaker housing 17 has an equalization opening 18. Furthermore, as an example, four connections 19 are shown that are constructed here as spring contacts.

The oscillation coil 13 is located in the area of a constant field generated by the magnet 10. By means of the connections 19, a loudspeaker signal is fed that comprises a wanted signal and a compensation signal. The oscillation coil 13 is excited as a function of the loudspeaker signal, wherein the loudspeaker membrane 14 is set into oscillation. The loudspeaker is consequently an electrodynamic loudspeaker in which the oscillation coil 13 is designed as a driver in interaction with the magnet 10.

The measurement microphone 12 captures noise in the surroundings of the loudspeaker and provides a noise signal as a function of this noise. As explained in detail below, the noise signal is fed by means of the contacts 19 to a control loop operating according to the feedback principle. This is, for example, the control loop shown in FIG. 4. As explained in detail below, the noise signal is converted in the control loop into the compensation signal and fed to the loudspeaker together with the wanted signal. Background noise in the vicinity of the loudspeaker is suppressed. It should be noted that although an electrical connection between microphone 12 and contacts 19 is not explicitly shown in the drawings, such a connection is readily apparent to anyone with ordinary skill in the art.

By minimizing the distance between the loudspeaker membrane 14 and measurement microphone 12, the time delay is also minimized. This leads to an increase of the bandwidth in which the active noise cancellation is effective.

Another advantage is to be seen in that, through the arrangement of the measurement microphone 12 within the loudspeaker membrane 14, an implementation of this loudspeaker can be realized with active noise cancellation in a single component. This is especially advantageous for the use of the loudspeaker, for example, in mobile telephones, where a flat construction is preferred. In such an application, the loudspeaker suppresses noise between the telephone and ear cup of the user. The noise occurs due to, for example, talking in the background of the user, which is often considered disruptive, in particular, when riding on public transportation.

Clearly it is to be recognized that the measurement microphone 12 is arranged in the acoustic center of the loudspeaker, that is, in the middle of the oscillation coil 13.

Figure 2:
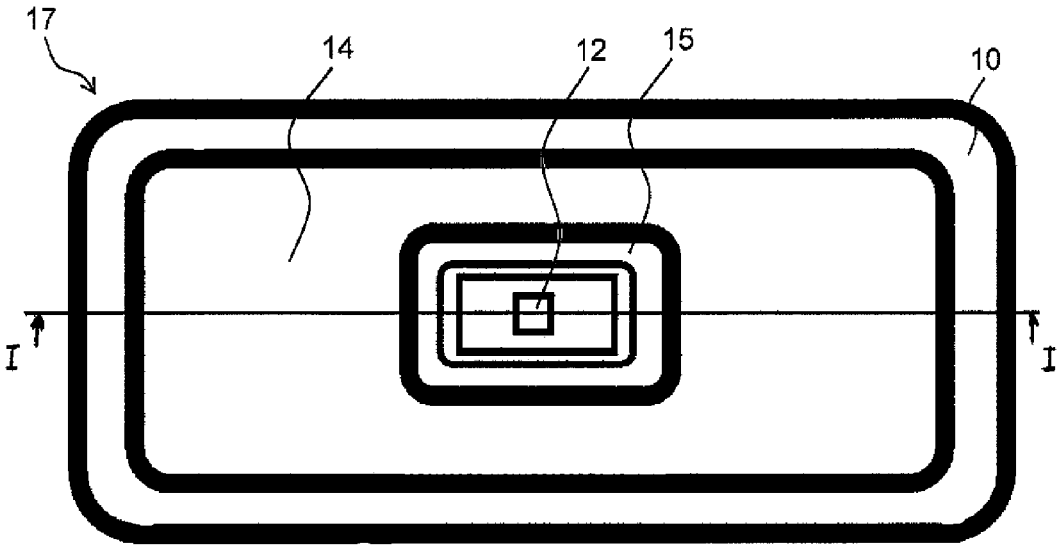
FIG. 2 is a top view of the embodiment from FIG. 1.

FIG. 2 shows a top view of the loudspeaker from FIG. 1. The rectangular shape of the loudspeaker membrane 14 between the inner border 15 and the outer border 16, as well as the coaxial placement of the measurement microphone 12, is to be seen.

Figure 3:
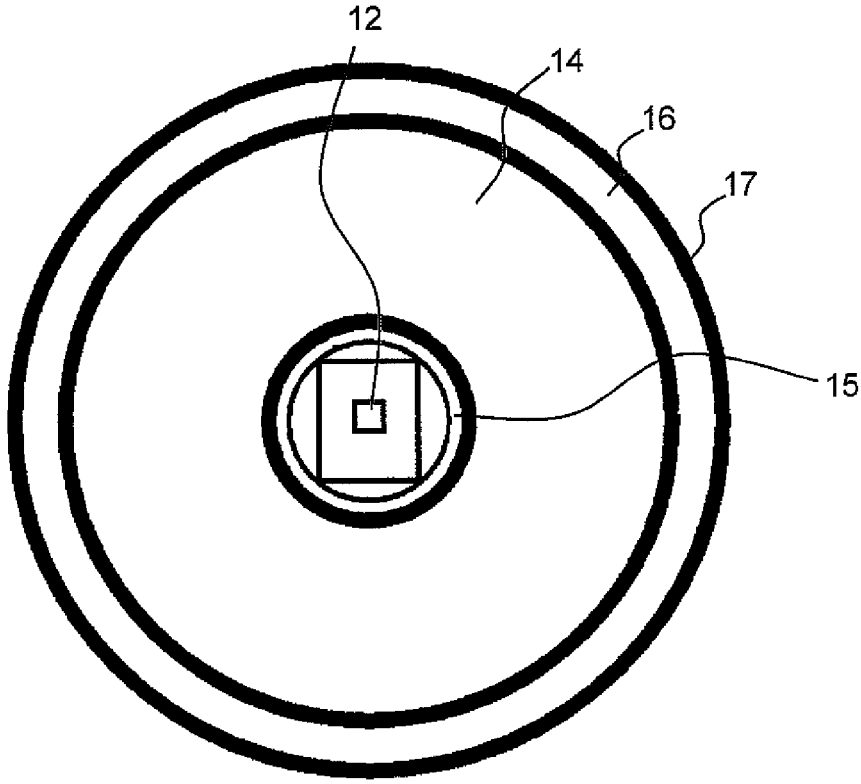
FIG. 3 depicts a second example embodiment of a loudspeaker according to the invention, shown in top view.

FIG. 3 shows a second example embodiment of a loudspeaker for active noise cancellation according to the invention in the top view. The loudspeaker membrane 14 has a round shape. It could be designated here as a ring emitter.

Figure 4:
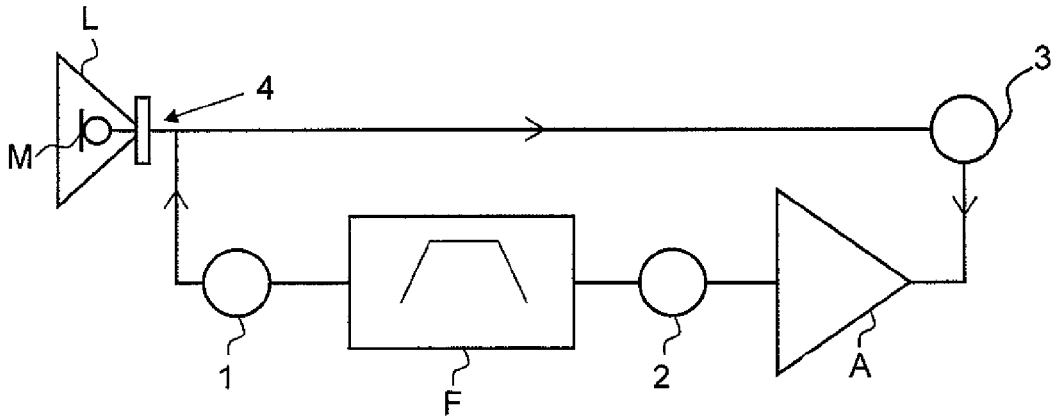
FIG. 4 depicts an example embodiment of a system for active noise cancellation according to the invention.

FIG. 4 shows an example embodiment of a system for active noise cancellation according to the invention. A loudspeaker L is coupled with a control loop. The loudspeaker L is here realized according to one of the embodiments of FIG. 1, 2, or 3 and comprises a measurement microphone M. The control loop comprises a filter F and an inverter A connected after this filter.

The measurement microphone M measures the background noise and provides a noise signal 1. The noise signal 1 is fed to the filter F. The filter F realizes the inverted transfer function from the loudspeaker L to the measurement microphone M. The signal 2 provided by the filter F is inverted in an inverter A. The compensation signal 3 obtained in this way is fed together with a wanted signal 4 again to the loudspeaker L.

The inverter A is constructed, for example, as an inverting amplifier.

The advantageous arrangement of measurement microphone M and loudspeaker L in which the distance between these components is minimized increases the phase margin and thus the bandwidth of the system considerably. The stability of the control loop is increased; oscillations are avoided.

Figure 5:
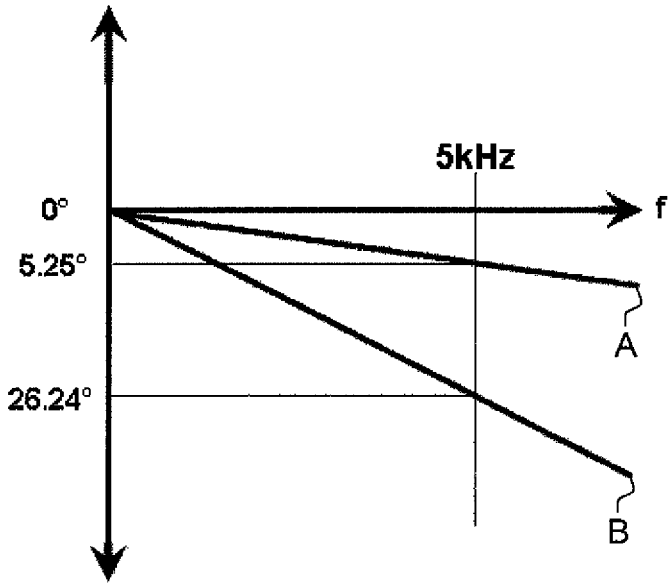
FIG. 5 is a diagram with example phase responses.

FIG. 5 shows a diagram with example phase responses. Shown is the repective phase response of a noise signal recorded by a measurement microphone with respect to the frequency f. A phase difference shown on the Y-axis is indicated in degrees. A straight line B represents the phase response for a loudspeaker microphone arrangement in which the microphone is mounted approximately 5 mm in front of the loudspeaker. This corresponds to the prior art. A straight line A represents the phase response of the open control loop of a loudspeaker according to the invention in which the measurement microphone is mounted within the loudspeaker membrane.

As can be seen from the diagram, the phase shift of the straight line A is significantly smaller than that of the straight line B. At an example measurement point at 5 kHz, the phase shift of the straight line A equals 5.25°, while the phase shift of the straight line B already equals 26.24°. From this, an improvement of the phase margin at 5 kHz of approximately 20° is the result. This leads to a significant increase in the bandwidth for active noise cancellation.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

I claim:

1. A loudspeaker for active noise cancellation in which a measurement microphone is arranged in the acoustic center, the loudspeaker comprising:

a magnet that is designed for generating a constant magnetic field;

an oscillation coil that is arranged in the area of the constant magnetic field and is configured as an electrodynamic driver of the loudspeaker in interaction with the magnet; and a loudspeaker membrane that is suspended, connected mechanically to the magnet, between an inner border and an outer border, wherein the measurement microphone is arranged in the middle of a space surrounded by the inner border of the loudspeaker membrane, and wherein the acoustic center is located in the middle of the oscillation coil.

2. The loudspeaker according to claim 1, wherein the outer border of the loudspeaker membrane is connected to the oscillation coil and the inner border of the loudspeaker membrane is connected to the magnet.

3. The loudspeaker according to claim 1, further comprising a loudspeaker housing that is connected to the outer border of the loudspeaker membrane and to a bottom side of the magnet and that has an equalization opening.

4. The loudspeaker according to claim 3, wherein, on the bottom side of the loudspeaker housing, at least two contacts are provided for feeding a loudspeaker signal and for providing a noise signal in the function of the measurement microphone.

5. The loudspeaker according to claim 1, wherein the loudspeaker membrane is constructed as a flat membrane in a round or rectangular shape.

6. The loudspeaker according to claim 1, wherein the measurement microphone is constructed as an electret microphone or as a MEMS microphone.

7. The loudspeaker according to claim 1, wherein the loudspeaker is constructed as a surface-mountable component.

8. The loudspeaker according to claim 1, wherein the loudspeaker is configured for use in a control system with signal feedback.

9. The loudspeaker according to claim 1, wherein the magnet is surrounded by a housing that encloses it together with the loudspeaker housing.

10. A system for active noise cancellation comprising:

a loudspeaker according to claim 1, and a control loop that is coupled with the loudspeaker and to whose input is fed a noise signal provided by the measurement microphone of the loudspeaker and at whose output a compensation signal is provided that is fed superimposed with a wanted signal to the loudspeaker as the loudspeaker signal.

11. The system according to claim 10, wherein the control loop comprises a filter that is coupled with the input of the control loop and an inverter that is connected after this filter and at whose output the compensation signal is provided.

* * * * *